US007493746B1

(12) United States Patent
Zielinsky

(10) Patent No.: US 7,493,746 B1
(45) Date of Patent: Feb. 24, 2009

(54) APPARATUS AND METHOD FOR SEPARATING STRANDS OF FLOSS, STRING, THREAD OR YARN FROM A BUNDLE

(75) Inventor: Cary Russell Zielinsky, Liberty, UT (US)

(73) Assignee: CRZ, Inc., Liberty, UT (US)

( * ) Notice: Subject to any disclaimer, the term of this patent is extended or adjusted under 35 U.S.C. 154(b) by 0 days.

(21) Appl. No.: 11/986,596

(22) Filed: Nov. 23, 2007

(51) Int. Cl.
*D07B 7/18* (2006.01)

(52) U.S. Cl. ..... 57/2.3

(58) Field of Classification Search ..... 57/2.3, 57/1 UN; 43/42.19
See application file for complete search history.

(56) References Cited

U.S. PATENT DOCUMENTS

| | | | | | |
|---|---|---|---|---|---|
| 1,987,777 | A | | 1/1935 | Jewett | |
| 2,377,173 | A | | 5/1945 | Nelson | |
| 2,543,924 | A | * | 3/1951 | Mondy | 248/406.1 |
| 2,967,372 | A | * | 1/1961 | Pass et al. | 43/43.13 |
| 2,992,297 | A | * | 7/1961 | Toney | 379/438 |
| 3,413,791 | A | * | 12/1968 | Feld | 57/2.3 |
| 3,734,374 | A | | 5/1973 | Perry | |
| 3,836,086 | A | | 9/1974 | Kodama | |
| 4,257,183 | A | * | 3/1981 | Arms | 43/42.19 |
| 4,584,829 | A | | 4/1986 | Heinke | |
| 5,678,400 | A | | 10/1997 | Heard | |
| H1865 | H | * | 10/2000 | Aoki | 43/42.13 |
| 2002/0108293 | A1 | * | 8/2002 | Bambacigno | 43/42.19 |

* cited by examiner

*Primary Examiner*—Shaun R Hurley

(57) ABSTRACT

An apparatus and method for separating strands of floss, string, thread or yarn from a bundle. One embodiment of an apparatus for separating strands of floss, string, thread or yarn from a bundle that consists of an attachment device (12) with low mass, low moment of inertia and low rotational air resistance that attaches to one end of the bundle (10). The opposing end of the attachment device (12) is connected to a swivel assembly (14). The opposing end of the swivel assembly (14) is attached to a rotational energy absorption device (16) with higher mass, higher moment of inertia and higher rotational air resistance. The rotational energy absorption device (16) is depicted in one embodiment as a bob. Other embodiments are described and shown.

5 Claims, 5 Drawing Sheets

10
12
12a
14
14b
15
16b

APPARATUS AND METHOD FOR SEPARATING STRANDS OF FLOSS, STRING, THREAD OR YARN FROM A BUNDLE

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND—FIELD OF INVENTION

This invention relates generally to the field of needlecrafts, specifically to an apparatus and method for separating strands of floss, string, thread or yarn from the original bundle in which they are delivered.

BACKGROUND—PRIOR ART

Persons who use various types of floss, string, thread or yarn for crafts often need to separate the individual strands or groups of strands from the amorphous elongated bundle in which they are marketed. A bundle is called a skein or hank and normally ranges from three to six strands delivered in various yardages. Often, the skein or hank will be folded and cut by the user to shorten strands to a more usable and convenient length. Invariably, the strands are not perfectly aligned but rather are twisted and when an attempt is made to separate a single strand or group of strands from the bundle, tangles and knots occur.

This is a hand operation and the problem being solved is one of hand manipulation by individuals doing the craft work. It is not related to large manufacturing processes which may have different means for separating strands of thread. Manufacturing operations may have some discretion in what they buy and the condition of it when it arrives. Individuals who purchase floss, string, thread or yarn for crafts in retail stores do not have that option. These materials come as a large collection of fibers in an elongated bundle and with the individual strands somewhat twisted with respect to the other strands in the bundle. Patents to Jewett, U.S. Pat. No. 1,987,777 and Kodama, U.S. Pat. No. 3,836,086, teach the collection of a limited number of strands from a larger array, but the collection of a plurality of strands is not a problem being solved by this invention. A patent to Nelson, U.S. Pat. No. 2,377,173, discloses a commercial process for separating elongated threads and delivering them to feed rollers for whatever use they may have. A patent to Perry, U.S. Pat. No. 3,734,374, discloses guide mechanisms for aligning threads which have already been separated. A patent to Heard, U.S. Pat. No. 5,678,400, discloses an apparatus and method for untwisting cable yarn so as to enable testing of individual carpet fiber components. None of these patents appear to recognize the problem of the individual desiring to quickly and easily separate an individual or a plurality of strands as a unit from the bundle purchased from the local retailer.

A patent to Heinke, U.S. Pat. No. 4,584,829, discloses a method for separating strands of embroidery floss. This patent appears to recognize the problem of the individual desiring to quickly and easily separate an individual strand or perhaps a plurality of strands as a unit from the bundle purchased from the local craft or fabric shop. This separation invention is somewhat cumbersome to use, requiring the threading of individual or groups of strands through a series of slots while maintaining those strands already threaded within their respective slots. This may be difficult for those with limited hand mobility to use comfortably. This separation invention appears to be specific to embroidery floss and does not address the other forms that various craft strands are delivered in, which may also require a means and method of separation. This separation device appears to lack the necessary design to accommodate various sizes and weights of alternate craft materials. This patent has not been commercialized, thus strand separation remains a hand operation for the crafter, one not susceptible of any known solution other than the tedious finger manipulation currently used.

SUMMARY

This invention provides an apparatus and method for easily and reliably separating a broad range of strands of floss, string, thread or yarn from a bundle without tangles or knots. It comprises a simple tool and method which solves the problem of tedious hand separation. It is small, lightweight, and provides an economical means of strand separation, as it reduces waste of material by preventing tangles and knots. There are currently no strand separating devices available to crafters at market.

Other objects and advantages of the present invention will become apparent from the following descriptions. Taken in connection with the accompanying drawings, wherein, by way of illustration and example, an embodiment of the present invention is disclosed.

In accordance with one embodiment of the invention, there is disclosed an apparatus for separating strands of floss, string, thread or yarn from the bundle comprising: an attachment device which is affixed at one end to the bundle and at the opposite end to a swivel assembly which in turn attaches to a rotational energy absorption device.

In accordance with one embodiment of the invention, there is disclosed a method of separating individual or groups of strands of material from the bundle of strands collected as a length of floss, string, thread or yarn comprising: affixing the attachment device to one end of the bundle of floss, string, thread or yarn; resting the apparatus on your lap, floor or other convenient location, depending on the length of the bundle being separated; separating the end of at least one strand from the bundle; holding the strand(s) to be separated in one hand and the remaining bundle in the other; evenly lifting the strand(s) with both hands until the apparatus is suspended; separating your hands until the strand(s) to be separated is (are) parted all the way down to the attachment device, remove strand(s), repeat as necessary. After the strand(s) have been separated from the bundle, simply remove the separated strand(s) from the attachment device and use as desired. The use of this apparatus in the particular method outlined prevents the remaining bundle from tangling with the individual or grouped strands as they are parted. This saves considerable time and irritation to the individual during the craft making process.

Objects of the invention not clear from the above will be clear from an observation of the drawings and a reading of the detailed description describing one embodiment which follows.

DRAWINGS—FIGURES

The drawings constitute a part of this specification and include exemplary embodiments to the invention, which may be embodied in various forms. It is to be understood that in some instances various aspects of the invention may be shown exaggerated or enlarged to facilitate an understanding of the invention.

DRAWINGS—REFERENCE NUMERALS

| | | | |
|---|---|---|---|
| 10 | bundle | 12 | attachment device |
| 12a | securing arm of 12 | 14 | swivel assembly |
| 14a | eyelet of 14 | 14b | snap of 14 |
| 15 | opposing attachment device depicted as the ribbon | 15a | opposing attachment device depicted as a clamp |
| 16 | rotational energy absorption device depicted as the bob | 16a | securing hole in the bob |
| 16b | rotational energy absorption device depicted as the stationary object | 16c | rotational energy absorption device depicted as a table top |
| 18 | strand(s) to be separated | 18b | remaining bundle |

DETAILED DESCRIPTION—FIG. 1—PREFERRED EMBODIMENT

Figure 1:
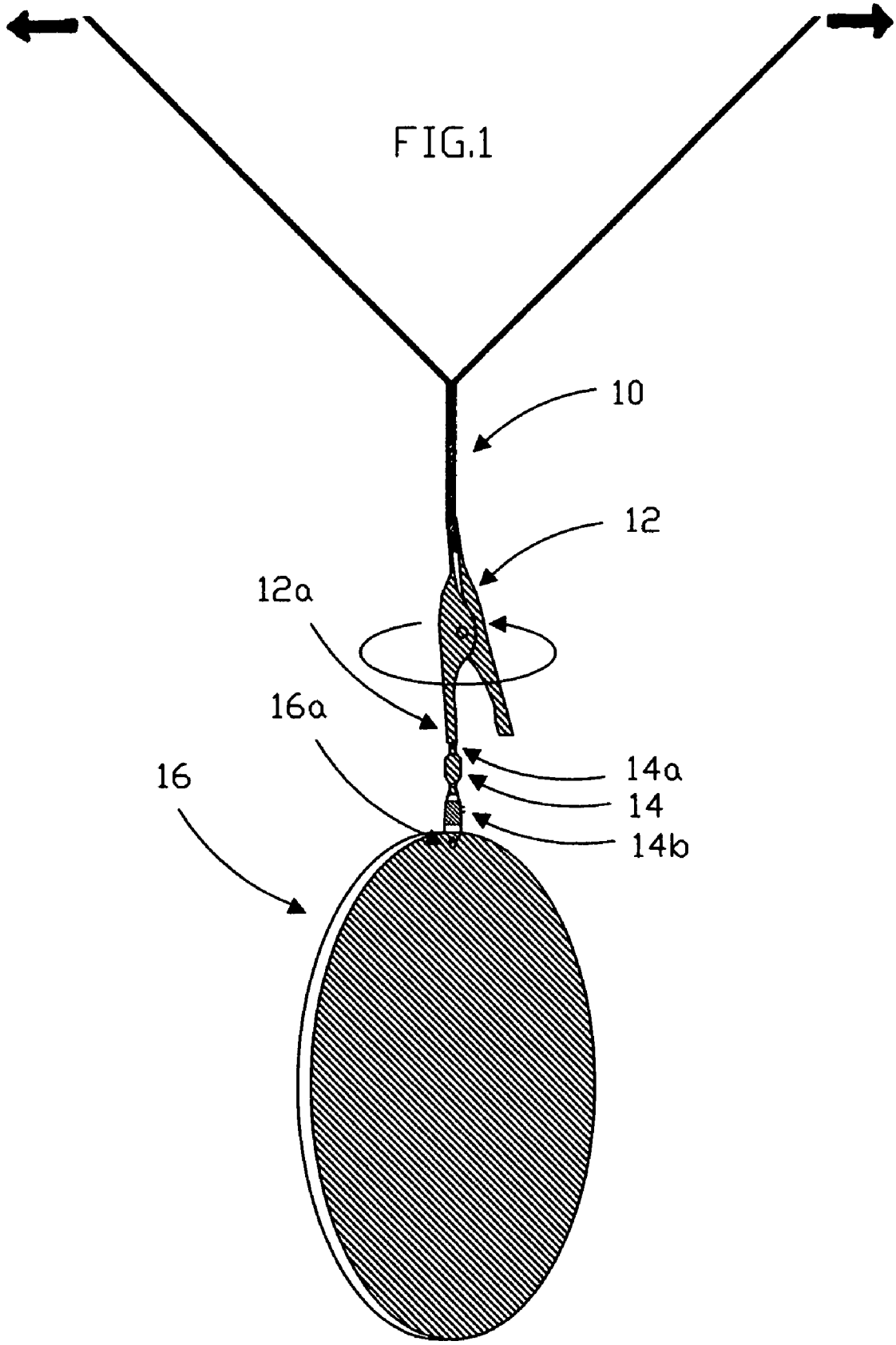
FIG. 1 shows a perspective view of an embodiment in which a bob is used as a rotational energy absorption device.

One embodiment of the apparatus is illustrated in FIG. 1 (perspective view). It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

As shown in FIG. 1, the apparatus according to the invention generally includes an attachment device 12, with low mass, low moment of inertia, and low rotational air resistance. In the preferred embodiment, the attachment device 12 is an alligator clip. However, the attachment device 12 can be of any other type of clip or clamp that will close, such as a small close pin, a plastic clamp, a metal binder clip, etc. The attachment device 12 affixes to one end of the bundle 10. The other end of the attachment device 12 is affixed to a swivel assembly 14. The opposing end of the swivel assembly 14 is affixed to a higher mass, higher moment of inertia and higher rotational air resistance, rotational energy absorption device 16. In this embodiment, the rotational energy absorption device 16 is the bob.

Figure 2A:
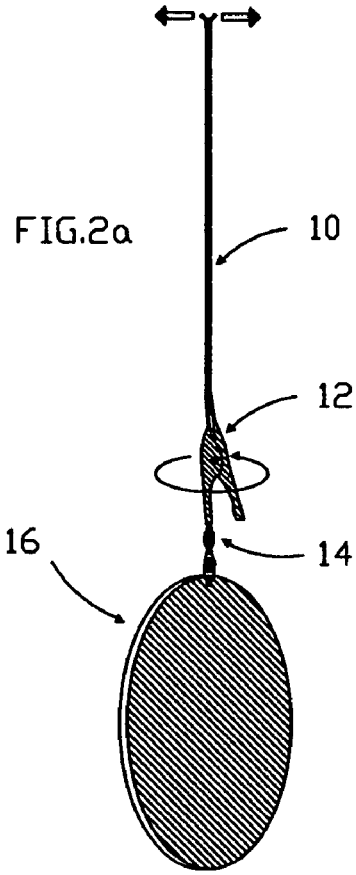
FIG. 2 shows a perspective view of three phrases of the strand separation method.
Figure 2B:
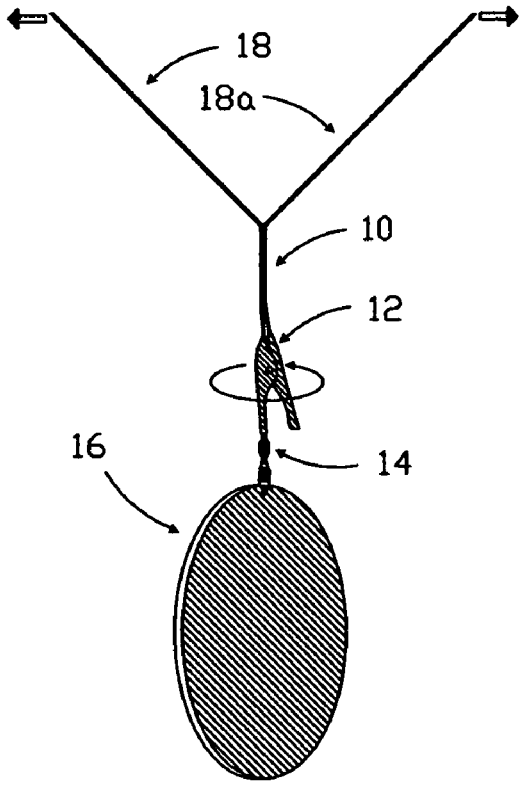
Figure 2C:
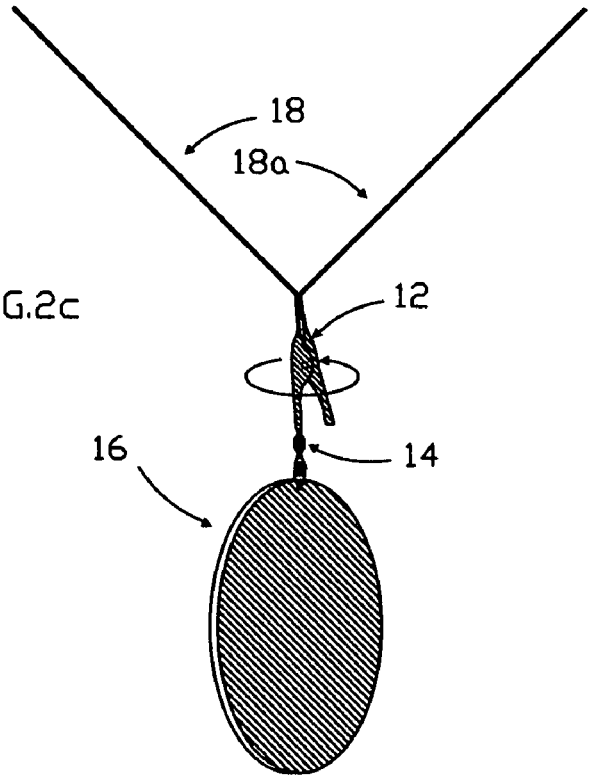

The attachment device 12, which needs to rotate in order to allow the stand(s) to separate from the bundle 10, can accelerate quickly (rotating about its axis), due to its low mass, low moment of inertia and low rotational air resistance. The low mass, low moment of inertia characteristics also minimize the momentum of the rotating attachment device 12 so as to minimize counter winding of the separated threads. The swivel assembly 14 connects the attachment device 12 to the rotational energy absorption device 16 and allows the attachment device 12 to rotate freely as the strands unwind and separate from each other as shown in FIGS. 2*a*, 2*b* and 2*c* (perspective view of three phases of strand separation). The swivel assembly 14 has an eyelet 14*a* which may be secured to the attachment device 12 by crimping the end of a securing arm 12*a* around the eyelet 14*a*. Alternatively, the swivel assembly 14 may be secured thereto by wire loop, adhesive bonding, soldering and/or welding. The opposite end of the swivel assembly 14 has a snap 14*b*, which is attached to the rotational energy absorption device 16 through a securing hole 16*a*. Alternatively, the opposite end of the swivel assembly 14 may be attached thereto by wire loop, adhesive bonding, soldering and/or welding.

There is a small amount of rotational energy transferred from the rotating attachment device 12 through the swivel assembly 14 (due to friction within the swivel) to the rotational energy absorption device 16. This transferred rotational energy is then dissipated by the higher mass, higher moment of inertia and higher rotational air resistance rotational energy absorption device 16.

Figure 3:
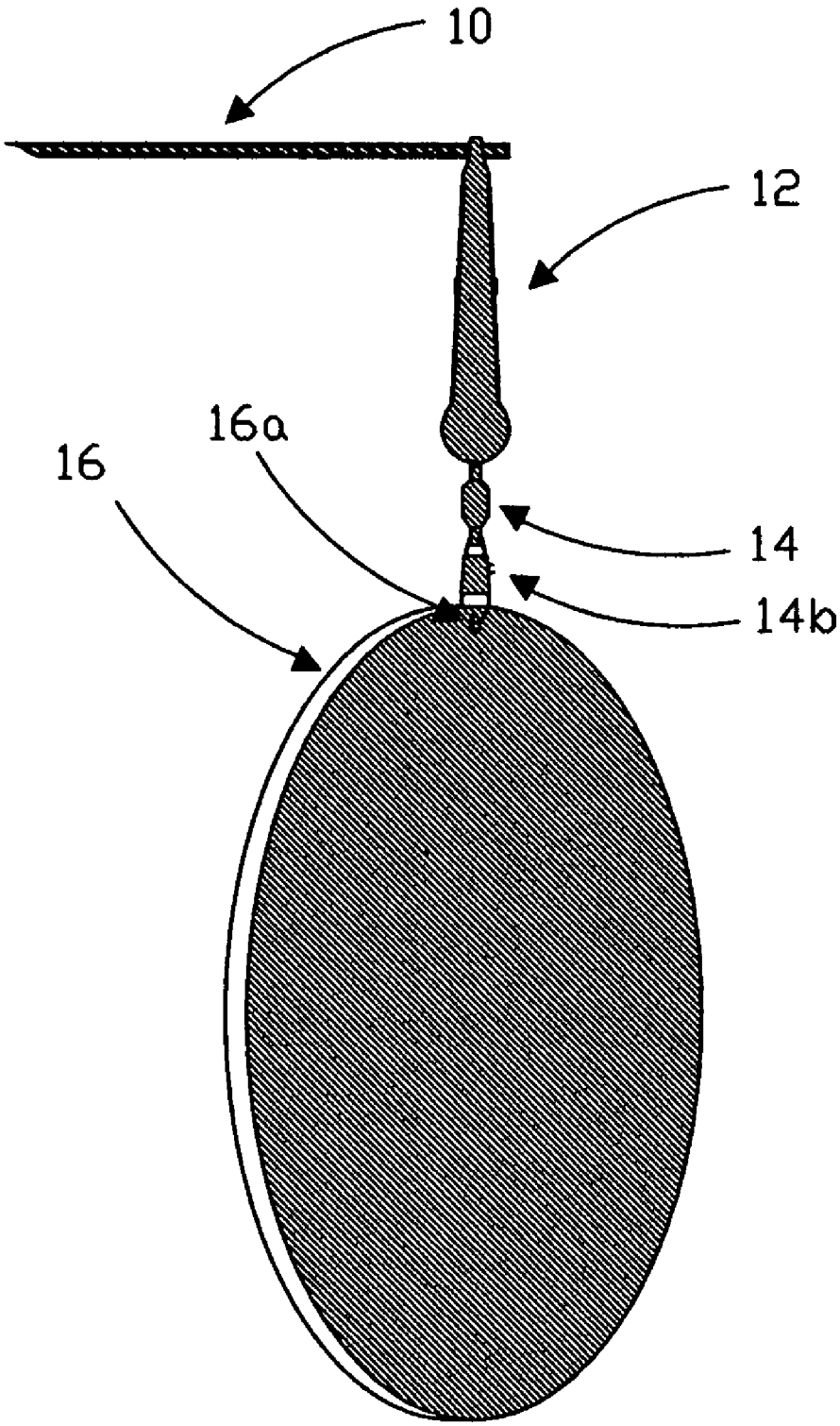
FIG. 3 shows an elevation view of an attachment method.

Operation—FIGS. 2, 3

This embodiments' function can best be described by the procedural steps used in separation of the strand(s) to be separated 18 from the remaining bundle 18*a* using the apparatus shown in the drawings FIGS. 2*a*, 2*b*, and 2*c*, and FIG. 3 (elevation view of an attachment method).

One begins as shown in FIG. 3, by securing one end of the bundle 10 into the jaws of the attachment device 12. The preferred method is to insert the bundle 10 into the jaws of the attachment device 12 with the axis of the bundle 10 perpendicular to the axis of the attachment device 12. One then places the apparatus on their lap, floor or other convenient location, depending on the length of the bundle 10 being separated. As shown in FIG. 2*a*, one then uses their fingers to part the end of the strand(s) 18 from the remaining bundle 18*a*. One then holds the strand(s) 18 in one hand while grasping the remaining bundle 18*a* in the other. One then lifts both hands evenly until the apparatus is suspended as shown in FIGS. 2*a* and 2*b*. One then slowly separates their hands until the strand(s) 18 and remaining bundle 18*a* are parted all the way down to the attachment device 12, as illustrated in FIGS. 2*b* and 2*c*. One then removes the strand(s) 18 from the attachment device 12. One may then repeat the above mentioned steps, as necessary, until all desired strand(s) 18 have been separated from the remaining bundle 18*a*.

Figure 4:
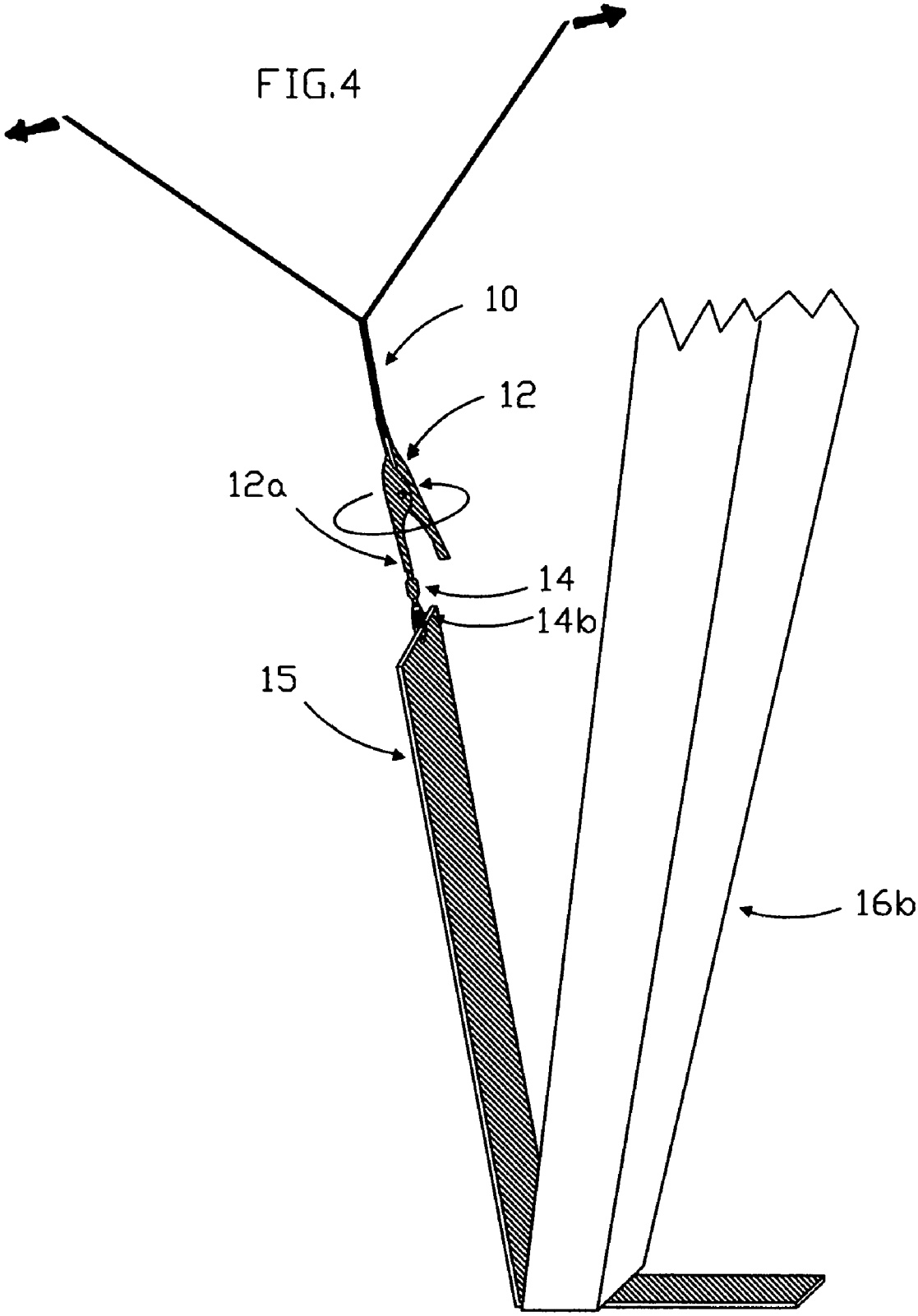
FIG. 4 shows an alternative embodiment in which a ribbon is used as an opposing attachment device.
Figure 5:
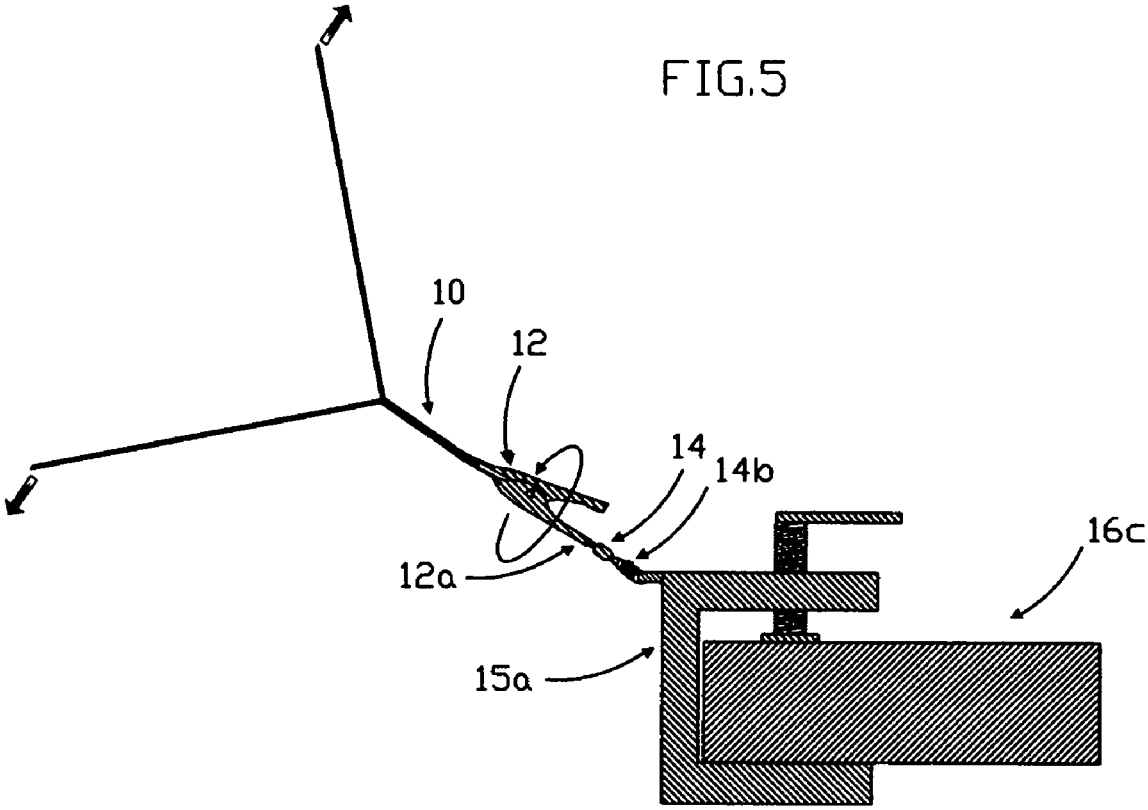
FIG. 5 shows an alternative embodiment in which a stationary objects is used as the rotational energy absorption device.

FIGS. 4 and 5—Additional Embodiments

FIG. 4 is an example of an alternative embodiment where the swivel assembly 14 is secured to the opposing attachment device depicted as the ribbon 15, which is held secure by a table leg. In this embodiment the table leg is serving as an example of a stationary object which serves as the rotational energy absorption device 16*b*. Examples of some alternative forms that might be used in this embodiment are: placing the ribbon securely between your knees, under a foot, or under a piece of furniture.

FIG. 5 is an example of an alternative embodiment where the swivel assembly 14 is secured to an opposing attachment device depicted as a clamp 15*a*, which is secured to the rotational energy absorption device depicted as a table top 16*c*. Other examples of alternate forms of the opposing attachment device 15*a* are: a magnet, hook and loop, a suction cup, etc. These alternative forms of the opposing attachment device 15*a* can be used in conjunction with alternate forms of the rotational energy absorption device 16*c*, such as furniture parts or other stationary objects of sufficient weight.

Advantages

From the description above, a number of advantages of some embodiments of my apparatus and method for separating floss, string, thread or yarn from a bundle become evident:

(a) The ease of separation of one or more strands from a bundle of strands.

(b) The improvement in separation that provides for tangle free strands ready for use.

(c) The improvement in the speed of the separation process.

(d) The improvement in the ergonomics of strand separation for individuals, especially in aiding those with limited hand mobility.

(e) Minimizing the frustration that occurs when dealing with tangles and knots while crafting.

(f) The improvement in material costs due to a reduction of waste material resulting from tangles and knots.

(g) The use of the apparatus and method may be applied to alternative craft materials such as string, thread, or yarn.

CONCLUSIONS, RAMIFICATIONS AND SCOPE

Accordingly, the reader will see that the apparatus and method for separating strands of floss, string, thread or yearn from a bundle provides an easy and convenient process for the home environment where craft work is ordinarily performed. This provides the benefit of economically improving the problem encountered in the currently available means of separation of the individual strands, or a group of strands from the bundle. Due to the nature of floss, string, thread or yarn used in craft work, the individual strands are somewhat twisted when they are grouped into the bundle. It is well known to crafters that when one tries to hold the bundle in one hand and pull the desired strand(s) to be parted with the other hand, twisting and tangling of the distal end of the fiber(s) is almost invariably the result. The invention will prevent that tangling and as a result minimize frustration and increase the speed of the process. Furthermore, the apparatus and method provides additional advantages in that it is lightweight, compact and easy to store and carry;

it substantially reduces waste materials and improves cost of craft projects;

it offers ergonomic advantages to individuals with limited range of motion in their hands; and it improves speed and quality of strand separation.

Once properly separated, the strand(s) will be threaded through various craft tools designed for the desired application; an example of which may be the eye of a needle; and incorporated into a fabric or formed into a particular design. The process for performing the crafts is not a part of this invention but is well known to a large portion of the craft making public. Although the description above contains many specificities, these should not be construed as limiting the scope of the embodiment but as merely providing illustrations of some of the presently preferred embodiments. For example, the attachment device may have other shapes, or be made of various materials such as: wood, plastic or rubber, etc. The rotational energy absorption device, in the form of a bob, can be of various weights, materials, sizes and shapes such as; oval, star, or heart, etc. The opposing attachment device as a ribbon may or may not be elasticized.

Thus the scope of the embodiment should be determined by the appended claims and their legal equivalents, rather than by the examples given.

I claim:

1. An apparatus for separating strands of floss, string, thread or yarn from a bundle comprising:

(a) an attachment device that is a low mass, low moment of inertia and low rotational air resistance alligator clip that secures said bundle to a swivel assembly, (b) said swivel assembly that connects to a rotational energy absorption device, (c) said rotational energy absorption device, being either a higher mass, higher moment of inertia and higher rotational air resistance bob or a stationary object that is connected to said swivel assembly by an opposing attachment device.

2. An apparatus for separating strands according to claim 1, wherein said opposing attachment device is a ribbon.

3. An apparatus for separating strands according to claim 1, wherein said opposing attachment device is a clamp.

4. A method of separating individual strands of material from a bundle of strands collected as a length of floss, string, thread or yarn comprising:

(a) providing an apparatus for separating strands of floss, string, thread or yarn from a bundle comprising an attachment device comprising a low mass, low moment of inertia and low rotational air resistance alligator clip that secures said bundle to a swivel assembly, said swivel assembly that connects to a rotational energy absorption device, said rotational energy absorption device that is a higher mass, higher moment of inertia and higher rotational air resistance bob, (b) securing an alligator clip to one end of said bundle of floss, string, thread or yarn, (c) resting the apparatus on your lap, floor or other convenient location, depending on the length of said bundle being separated, (d) separating the end of at least one strand from said bundle, (e) holding said strand or strands to be separated in one hand and the remaining bundle in the other, (f) lifting said strand or strands and said remaining bundle until said apparatus is suspended, (g) slowly separate your hands until said strand to be separated is parted, or said strands to be separated are parted, all the way down to said attachment device, (h) remove said strand or strands, (i) repeat steps (b) through (h) until the desired number of strands has been separated.

5. A method of separating individual strands of material from a bundle of strands collected as a length of floss, string, thread or yarn comprising:

(a) providing an apparatus for separating strands of floss, string, thread or yarn from a bundle comprising an attachment device comprising a low mass, low moment of inertia and low rotational air resistance alligator clip that secures said bundle to a swivel assembly, said swivel assembly that connects to a rotational energy absorption device, said rotational energy absorption device that is a stationary object, (b) securing an alligator clip to one end of said bundle of floss, string, thread or yarn, (c) securing the opposing attachment device to a stationary object at the appropriate distance relative to the length of said bundle being separated, (d) separating the end of at least one strand from said bundle, (e) holding said strand or strands to be separated in one hand and the remaining bundle in the other, (f) lifting or pulling said strand or strands and said remaining bundle until there is tight tension between the swivel assembly and said attachment device that secures with said swivel assembly to the rotational energy absorption device, (g) slowly separate your hands until said strand to be separated is parted, or said strands to be separated are parted from said remaining bundle, all the way down to said attachment device, (h) remove said strand or strands, (i) repeat steps (b) through (h) until the desired number of strands has been separated.

* * * * *